US005997257A

United States Patent [19]

Ishida et al.

[11] Patent Number: 5,997,257

[45] Date of Patent: Dec. 7, 1999

[54] REFRIGERANT COMPRESSOR

[75] Inventors: Hiroyuki Ishida, Kounan-machi; Kazuo Eitai, Higashimatsuyama; Minoru Kanaizuka, Kounan-machi, all of Japan

[73] Assignee: Zexel Corporation, Tokyo, Japan

[21] Appl. No.: 09/009,792

[22] Filed: Jan. 20, 1998

[30] Foreign Application Priority Data

Jan. 28, 1997 [JP] Japan ..... 9-029547

[51] Int. Cl.[6] ..... F04B 1/12

[52] U.S. Cl. ..... 417/269; 184/6.17

[58] Field of Search ..... 417/269, 222.1, 417/313, 540; 92/71; 184/6.17

[56] References Cited

U.S. PATENT DOCUMENTS 5,533,871 7/1996 Takenaka et al. ..... 417/269
5,636,974 6/1997 Ikeda et al. ..... 417/269
5,704,769 1/1998 Michiyuki et al. ..... 417/269
5,718,566 2/1998 Ikeda et al. ..... 417/269
5,782,613 8/1998 Michiyuki et al. ..... 417/269
5,785,502 8/1998 Ota et al. ..... 417/222.2
5,823,294 10/1998 Mizutani et al. ..... 184/6.3

*Primary Examiner*—Timothy S. Thorpe
*Assistant Examiner*—David J Torrente
*Attorney, Agent, or Firm*—Frishauf, Holtz, Goodman, Langer & Chick, P.C.

[57] ABSTRACT

A refrigerant compressor has a first high pressure chamber formed in the rear head, a second high pressure chamber formed on the outer peripheral surface of the cylinder block, and a discharge passage communicating between the two. The discharge passage comprises at least one through hole through which a corresponding through bolt extends, at least one communication passage between the through hole and the first high pressure discharge chamber, at least one communication hole in the cylinder block communicating the through hole to the second high pressure chamber. Alternate embodiments include an oil reservoir and means for separating lubricant carried by the fluid flow within the discharge passage.

8 Claims, 7 Drawing Sheets

REFRIGERANT COMPRESSOR

BACKGROUND OF THE INVENTION

1. Field of the Invention

This invention relates to a refrigerant compressor, and more particularly to a refrigerant compressor having a high-pressure chamber formed on an outer peripheral surface of a cylinder block, for reducing pulsations.

2. Description of the Prior Art

FIG. 1 shows the whole arrangement of a conventional wobble plate compressor. FIG. 2 is a view taken on line II—II of FIG. 1, while FIG. 3 is a view taken on line III—III of FIG. 1.

The compressor has a cylinder block 101 formed with a plurality of cylinder bores 106 which axially extend therethrough at predetermined circumferential intervals about a drive shaft 105. The cylinder block 101 has a rear-side end face thereof secured to a rear head 103 via a valve plate 102, and the rear head 103 is formed therein with a discharge chamber 112 and a suction chamber 113.

The cylinder block 101 has a front-side end face thereof secured to a front head 104. The front head 104 has a crankcase 108 formed therein, in which a wobble plate 110 is received.

The rear head 103, cylinder block 101 and the front head 104 are tightened in a longitudinal direction by a plurality of through bolts, not shown, extending via through holes 131, 134, to form a one-piece assembly. Some of the through holes 131 extend through spaces 132 formed for reduction of the weight of the compressor.

On an outer peripheral surface of the cylinder block 101, there is formed a high-pressure chamber 122 for reducing high-pressure pulsations. The outer peripheral surface of the cylinder block 101 is formed therein with a recess 101*a*. A cover 160 is secured to a rim of opening of the recess 101*a* via an O ring 153. The high-pressure chamber 122 is defined by inner wall surfaces of the cover 160 and the recess 101*a* of the cylinder block 101. The high-pressure chamber (second high-pressure chamber) 122 communicates with the discharge chamber (first high-pressure chamber) 112 via a communication passage 136 extending in parallel with the drive shaft 105 and an oblique hole 135 extending obliquely radially outward from the discharge chamber 112.

The valve plate 102 is formed with refrigerant outlet ports 116 for each communicating between a corresponding one of the cylinder bores 106 and the discharge chamber 112, and refrigerant inlet ports 115 for each communicating between a corresponding one of the cylinder bores 106 and the suction chamber 113.

The refrigerant outlet ports 116 are each opened and closed by a corresponding one of discharge valves 117 fixed to the rear head-side end face of the valve plate 102 together with valve stoppers 118, by a rivet 119.

A guide hole 127 is formed in the vicinity of the rivet 119, for communicating between the discharge chamber 112 and a bearing-receiving hole 125 formed within the cylinder block 101, via a restriction hole 126.

High-pressure refrigerant gas within the discharge chamber 112 is supplied to the bearing-receiving hole 125 via the guide hole 127 and the restriction hole 126, and then further supplied from the bearing-receiving hole 125 to the crankcase 108 via a bearing-receiving hole 128. As a result, oil within the refrigerant gas is supplied to thrust bearings 145, 146, radial bearings 147, 148 and so forth.

The flow of the refrigerant gas flowing out of the discharge chamber 112 is restricted by the oblique hole 135 and the communication passage 136, so as to reduce pulsations generated within the second high-pressure chamber 122.

However, since the high-pressure chamber 122 is formed on the outer peripheral surface of the cylinder block 101, it is required to use not only a connecting element, i.e. a pipe connector 150 for connection between the cylinder block side and the rear head side but also O rings 151, 152 for sealing between the pipe connector 150 and the cylinder block 101 and between the pipe connector 150 and the rear head 103, respectively, which results in an increases in the outer diameter and weight of the compressor (rear head 103) as well as an increase in the manufacturing costs of the same due to an increase in the number of component parts and elements.

SUMMARY OF THE INVENTION

It is an object of the invention to provide a refrigerant compressor which is reduced in the number of component parts and elements, thereby attaining reduction of size and weight as well as manufacturing costs thereof.

To attain the above object, the present invention provides a refrigerant compressor including a cylinder block having one end face, another end face, and an outer peripheral surface, a valve plate, a rear head secured to the one end face of the cylinder block via the valve plate, a front head secured to the another end face of the cylinder block, the front head having a crankcase formed therein, a first high-pressure chamber formed within the rear head, a second high-pressure chamber formed on the outer peripheral surface of the cylinder block, a discharge passage communicating between the first high-pressure chamber and the second high-pressure chamber, and a plurality of through bolts each extending from the rear head to the front head through the cylinder block, for tightening the rear head, the cylinder block, and the front head in a longitudinal direction, to form a one-piece assembly.

The refrigerant compressor according to the invention is characterized in that the discharge passage comprises at least one through hole through which corresponding ones of the through bolts extend, respectively, at least one communication passage communicating between the at least one through hole and the first high-pressure chamber, and at least one communication hole formed in the cylinder block for communication between the at least one through hole and the second high-pressure chamber.

According to this refrigerant compressor, some of the through holes through which the through bolts extend are each made use of as part of the discharge passage communicating between the first high-pressure chamber and the second high-pressure. Therefore, the rear head is only required to be formed with part of the discharge passage, which communicates between the first high-pressure chamber and the through holes. This makes it possible to decrease the outer diameter of the rear head to thereby reduce the size and weight of the compressor. Further, connecting elements conventionally used for connecting the cylinder block and the rear head can be dispensed with, which contributes to reduction of the manufacturing costs of the compressor.

Preferably, the cylinder block is formed therein with at least one space formed continuous with the at least through hole, respectively.

According to this preferred embodiment, the provision of the at least one space makes it possible to reduce the weight of the compressor and at the same time make walls or solid portions of the cylinder block uniform in thickness. This prevents blow holes from being produced when casting the cylinder block, thereby preventing faulty pressure-tightness of the cylinder bores.

More preferably, the refrigerant compressor includes an oil reservoir formed in a bottom surface of each of the at least one space for collecting oil therein, and an oil supply passage formed through a portion of the cylinder block between the oil reservoir and the crankcase for supplying the oil from the oil reservoir to the crankcase.

According to this preferred embodiment, oil separated from refrigerant gas within the second high-pressure chamber is collected in the space, particularly in the oil reservoir thereof, and then the collected oil is returned to the crankcase via the oil supply passage, thereby increasing the amount of oil supply to the crankcase.

More preferably, the valve plate is formed therethrough with at least one through hole respectively continuous with the at least one space in the cylinder block, the bottom surface of the each of the at least one space being formed at a level lower than a corresponding one of the at least one through hole formed through the valve plate.

According to this preferred embodiment, it is possible to collect the oil more effectively in the space and the oil reservoir.

Alternatively, the bottom surface of the each of the at least one space is formed at the same level as a corresponding one of the at least one through hole, the bottom surface having an inclined surface thereof sloping down to the oil reservoir.

This preferred embodiment provides the same effects as obtained by the above preferred embodiment.

Further preferably, the each of the at least one space has a larger depth in a direction in which a corresponding one of the through bolts extend, in a manner such that refrigerant gas hits a threaded portion of the through bolt.

According to this preferred embodiment, refrigerant gas hits a threaded portion of the through bolt to be decelerated, so that the space is capable of performing separation of oil from refrigerant gas as well.

The above and other objects, features and advantages of the present invention will become more apparent from the following detailed description taken in conjunction with accompanying drawings.

DETAILED DESCRIPTION OF THE PREFERRED EMBODIMENTS

The invention will now be described in detail with reference to drawings showing preferred embodiments thereof.

Figure 1:
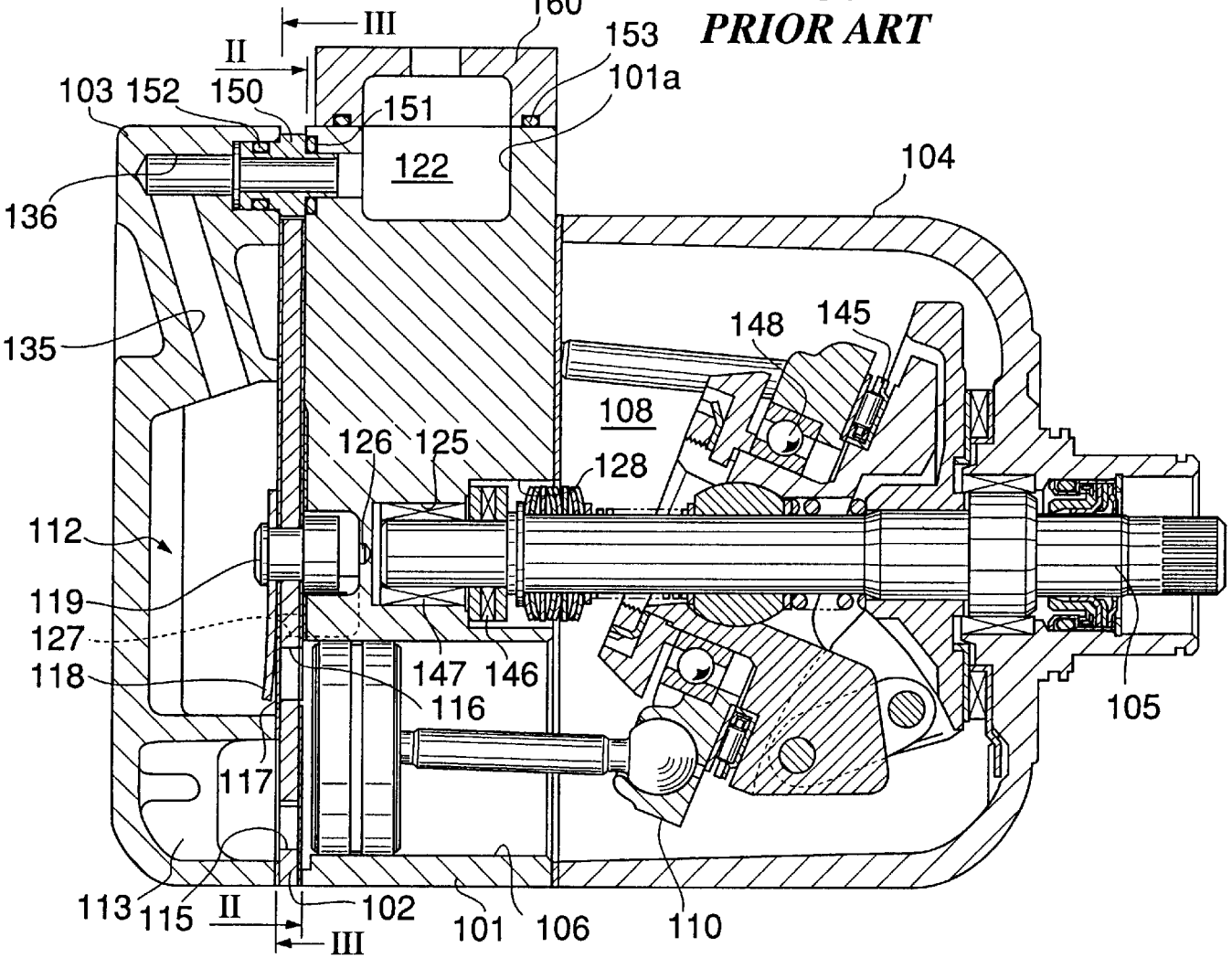
FIG.1 PRIOR ART
FIG. 1 is a longitudinal sectional view showing the whole arrangement of a conventional wobble plate compressor.
Figure 2:
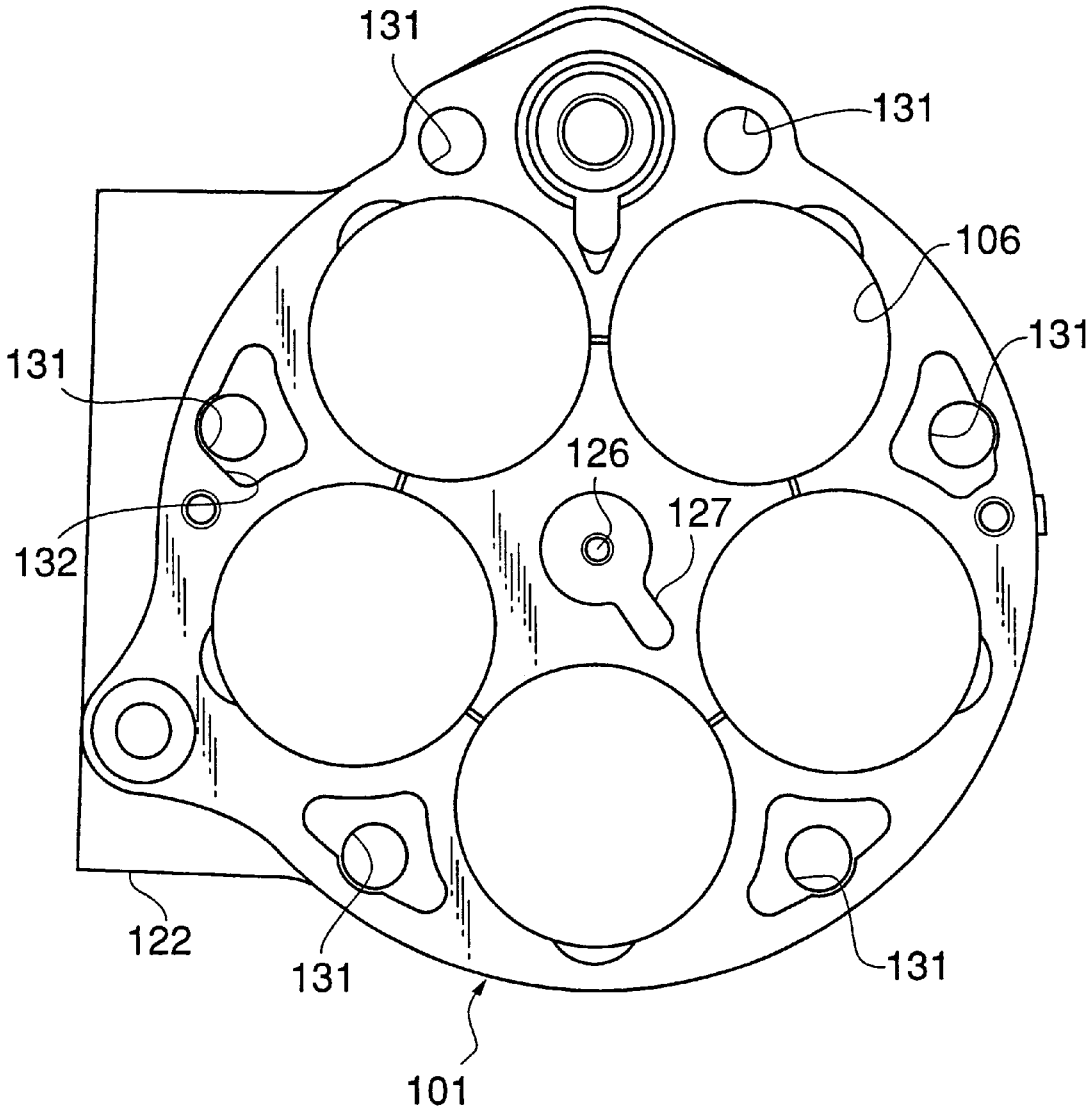
FIG.2 PRIOR ART
FIG. 2 is a view taken on line II—II of FIG. 1.
Figure 3:
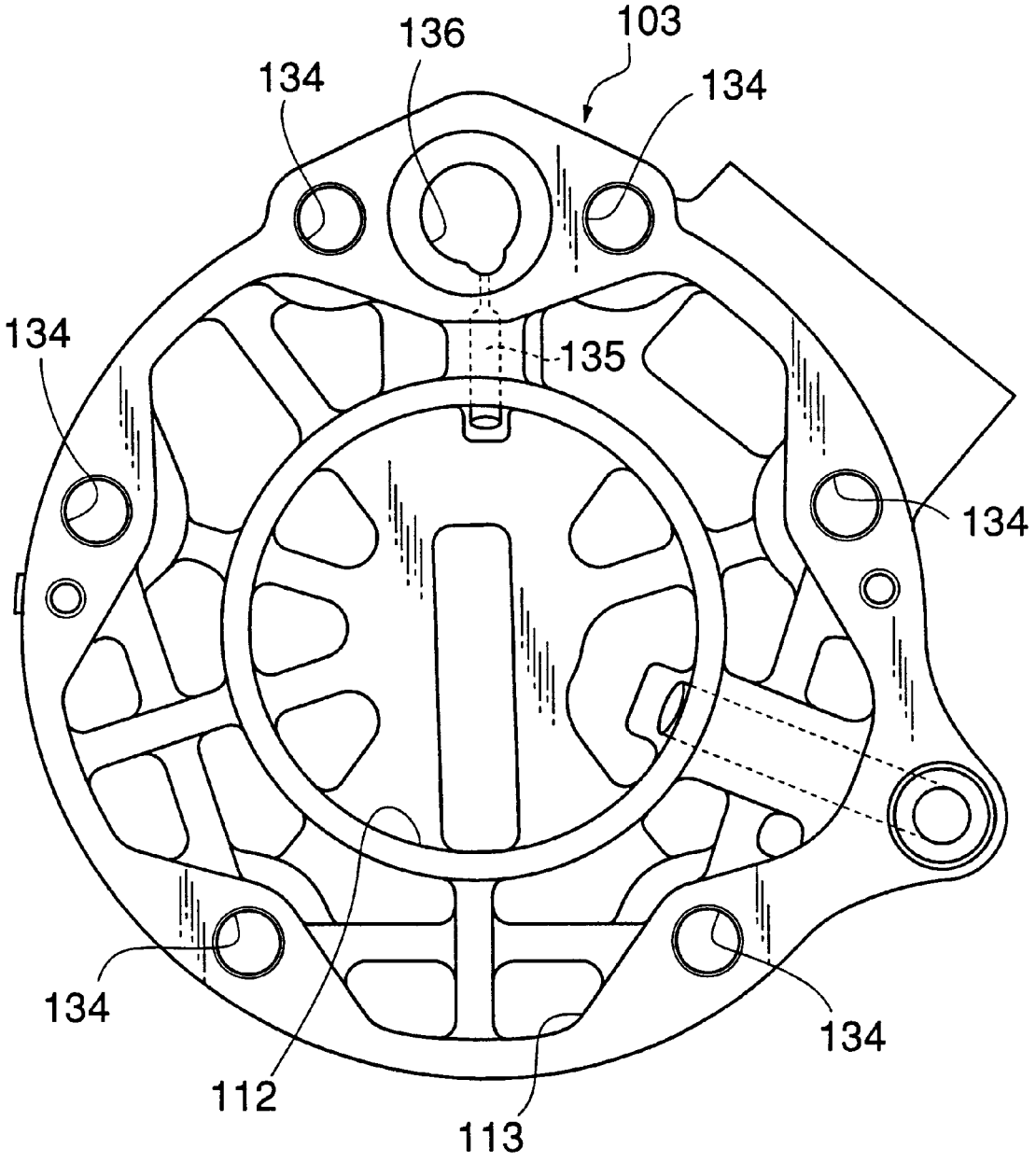
FIG.3 PRIOR ART
FIG. 3 is a view taken on line III—III of FIG. 1.
Figure 4:
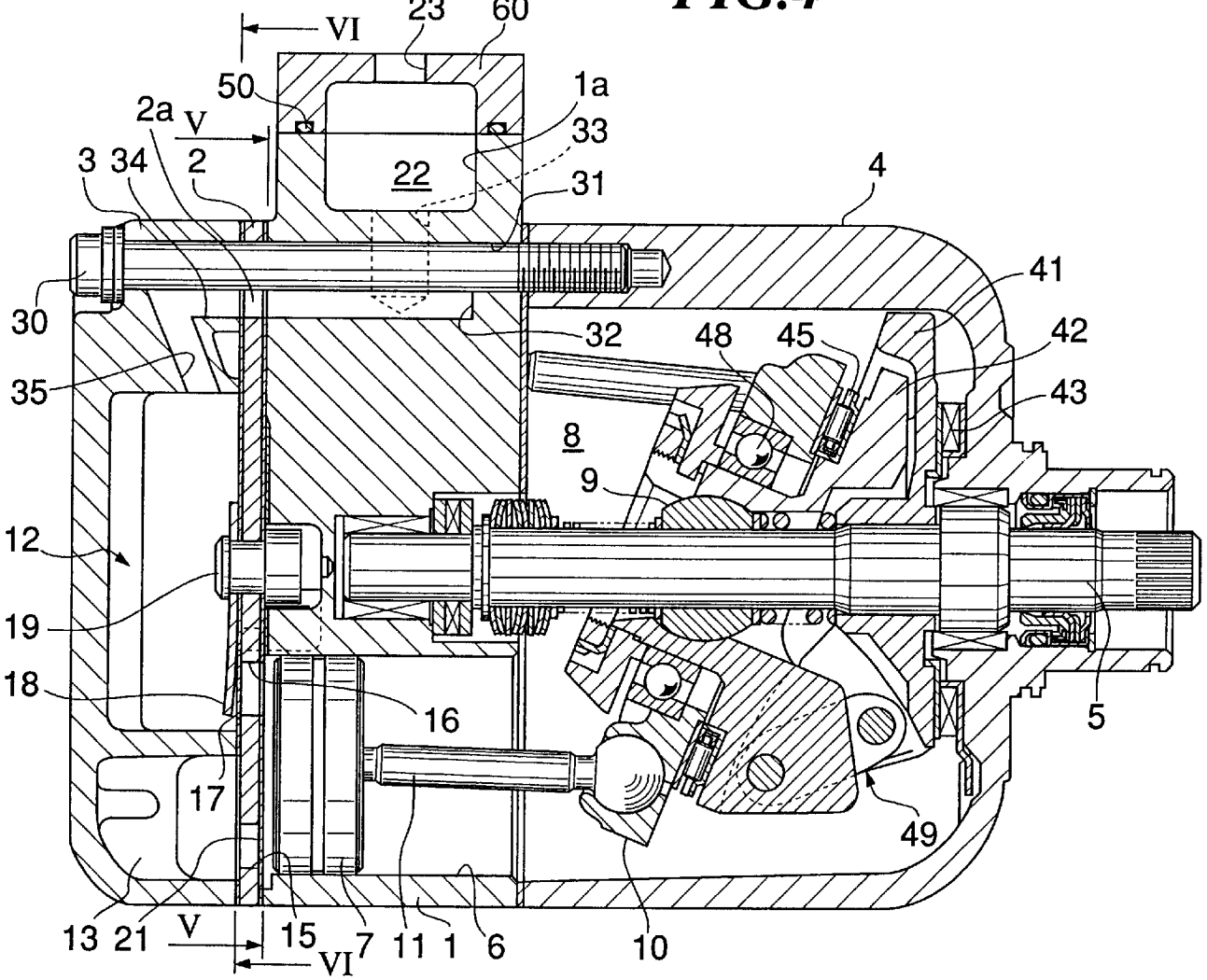
FIG. 4 is a longitudinal sectional view showing the whole arrangement of a wobble plate compressor according to a first embodiment of the invention.
Figure 5:
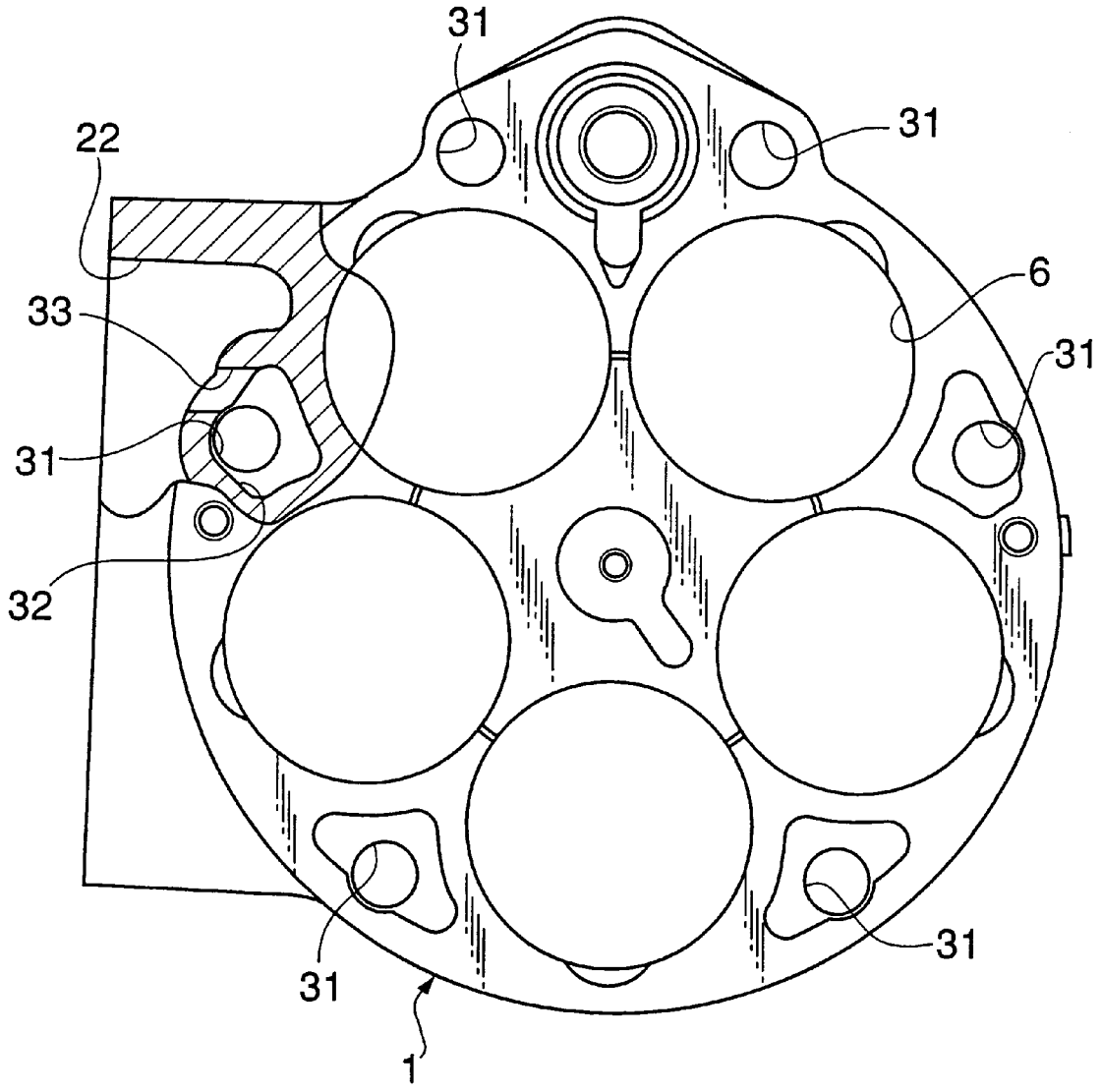
FIG. 5 is a view taken on line V—V of FIG. 4.
Figure 6:
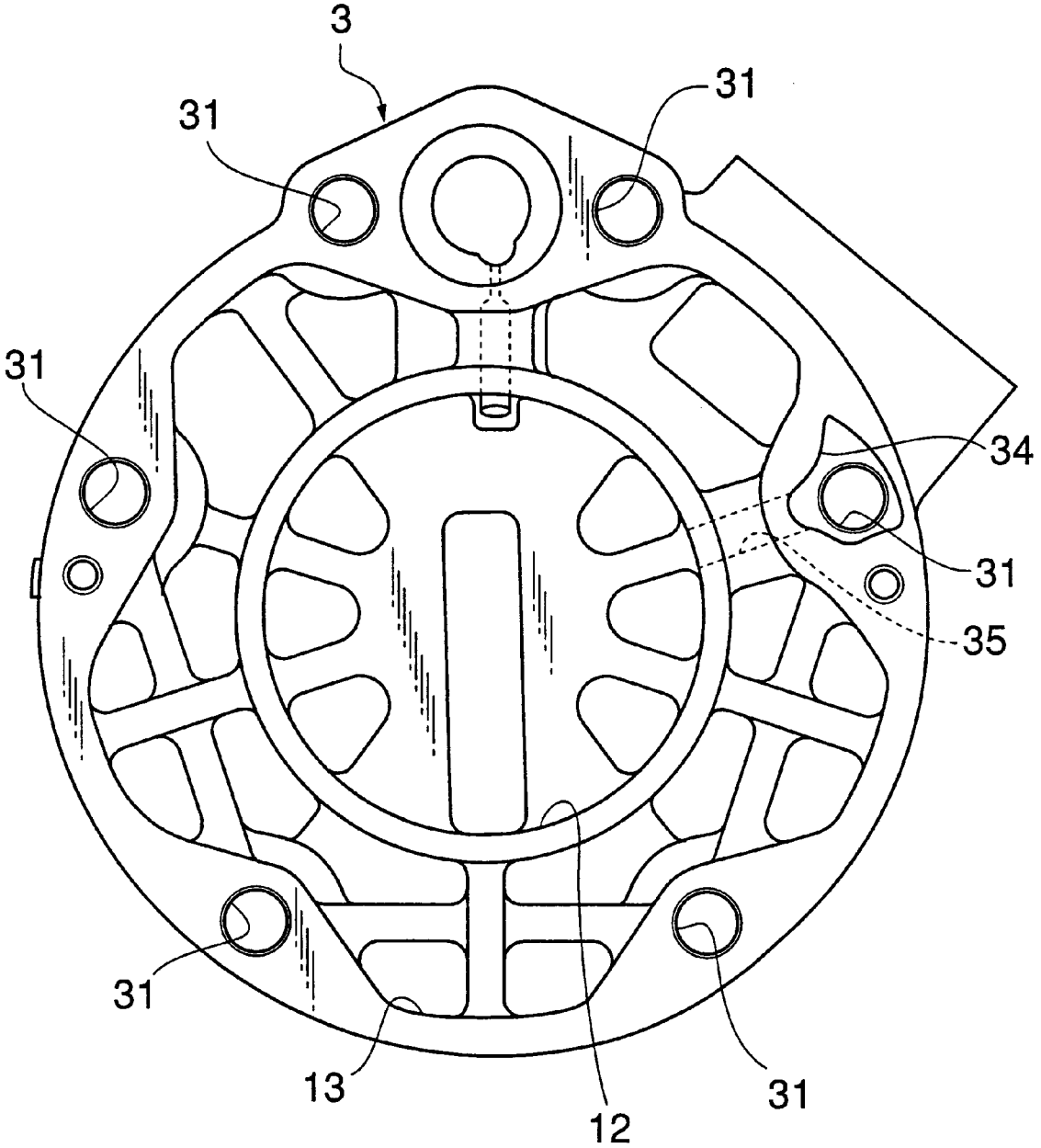
FIG. 6 is a view taken on line VI—VI of FIG. 4.

FIG. 4 shows the whole arrangement of a wobble plate compressor (refrigerant compressor) according to a first embodiment of the invention. FIG. 5 is a view taken on line V—V of FIG. 4, while FIG. 6 is a view taken on line VI—VI of the same.

The wobble plate compressor has a cylinder block 1 having one end face thereof secured to a rear head 3 via a valve plate 2 and the other end face thereof secured to a front head 4.

The rear head 3, the cylinder block 1 and the front head 4 are tightened in a longitudinal direction by a plurality of through bolts 30 extending from the rear head 3 to the front head 4 through the cylinder block 1, to form a one-piece assembly.

The cylinder block 1 is formed with five cylinder bores 6 which axially extend therethrough at predetermined circumferential intervals about a drive shaft 5. Each cylinder bore 6 has a piston 7 slidably received therein.

On an outer peripheral surface of the cylinder block 1, there is formed a high-pressure chamber (second high-pressure chamber) 22. The outer peripheral surface of the cylinder block 101 is formed therein with a recess 1*a*. A cover 60 is fixed to a rim of opening of the recess 1*a* via an O ring 50. The high-pressure chamber 22 is defined by inner wall surfaces of the cover 60 and the recess 1*a* of the cylinder block 1. The second high-pressure chamber 22 has an opening 23 formed through the cover 60, via which refrigerant gas within the high-pressure chamber 22 is discharged to a condenser, not shown, mounted on the front face of a radiator, not shown.

The cylinder block 1 has a plurality of spaces 32 formed therein for reducing the weight of the compressor. The spaces 32 are each formed in a fashion directly continuous with or merged with a corresponding one of the through holes 31 through which the through bolts 30 extend, respectively.

In general, when a hollow component part, such as a cylinder block having a plurality of cylinder bores formed therein, is formed by casting, if the component part has walls or solid portions different in thickness, it takes more time to cool thicker walls than thinner ones. This variation in cooling is liable to produce blow holes in the central portions of the respective thicker walls or solid portions. In the present embodiment, the spaces 32 are provided to make the walls or solid portions of the cylinder block 1 substantially uniform in thickness, thereby preventing blow holes from being produced due to variation in cooling when the cylinder block 1 is formed by casting. This prevents faulty pressure-tightness of the cylinder bores 6 caused by such blow holes.

A communication passage 33 is formed between each space 32 and the second high-pressure chamber 22.

The space 32 has a rear head-side opening which communicates with a passage 34 formed in the rear head 3 via a through hole 2*a* formed through the valve plate 2.

The rear head 3 is formed therein with a discharge chamber (first high-pressure chamber) 12 and a suction chamber 13 formed around the discharge chamber 12. The discharge chamber 12 and the passage 34 communicate with each other via an oblique hole 35 formed obliquely radially outward such that it does not extend across the suction chamber 13.

The valve plate 2 is formed with refrigerant outlet ports 16 for each communicating between a corresponding one of the cylinder bores 6 and the discharge space 12*a*, and refrigerant inlet ports 15 for each communicating between a corresponding one of the cylinder bores 6 and the suction chamber 13, at respective predetermined circumferential intervals.

The refrigerant outlet ports 16 are each opened and closed by a corresponding one of discharge valves 17 fixed to the rear head-side end face of the valve plate 2 together with valve stoppers 18, by a rivet 19.

On the other hand, the refrigerant inlet ports 15 are each opened and closed by a corresponding one of suction valves 21 arranged between the valve plate 2 and the cylinder block 1.

The front head 4 has a crankcase 8 formed therein, in which are received a thrust flange 41, a drive hub 42, and a wobble plate 10.

The thrust flange 41 is rigidly fitted on the drive shaft 5. The thrust flange 41 is rotatably supported on an inner wall of the front head 4 by a thrust bearing 43.

The drive hub 42 is rotatably mounted on the drive shaft 5 via a hinge ball 9 and at the same time connected to the thrust flange 41 via a linkage 49.

The wobble plate 10 is mounted on the drive hub 41 via a thrust bearing 45 and a radial bearing 48 such that the wobble plate 10 can perform wobbling motion.

Further, the wobble plate 10 has each piston 7 connected thereto by a connecting rod 11, and the piston 7 moves in a corresponding one of the cylinder bores 6 in a reciprocating manner according to the axial wobbling motion of the wobble plate 10. The degree of inclination of the wobble plate 10 varies with pressure within the crankcase 8.

Next, the operation of the wobble plate compressor constructed as above will be described.

When torque of an engine, not shown, is transmitted to the drive shaft 5 to rotate the same, the thrust flange 41 and the drive hub 42 rotate in unison with the drive shaft 5, whereby the wobble plate 10 performs axial wobbling motion. The axial wobbling motion of the wobble plate 10 causes reciprocating motion of each piston 7 in the cylinder bore 6, which causes variation in the volume of a compression chamber within the cylinder bore 6 corresponding to the piston 7. As the volume of the compression chamber varies, suction, compression and delivery of refrigerant gas are carried out sequentially. Thus, high-pressure refrigerant gas is delivered in an amount corresponding to an angle of the inclination of the wobble plate 10.

When the discharge valve 17 opens, refrigerant gas compressed within the compression chamber is delivered to the discharge chamber 12 via the refrigerant outlet port 16. Then, the refrigerant gas within the discharge chamber 12 flows into the high-pressure chamber 22 through the oblique hole 35, the passage 34, the space 32, and the communication passage 33. The amount of refrigerant gas which is to flow into the high-pressure chamber 22 is restricted in the oblique hole 35, the passage 34, the through hole 2*a*, the space 32, and the communication passage 33. As a result, drastic changes in pressure are prevented from occurring within the second high-pressure chamber 22, which makes it possible to reduce pulsations caused by an increase in volume of refrigerant gas within the second high-pressure chamber 22.

According to the first embodiment, it is possible to dispense with the pipe connector 150 and the two O rings 151, 152 which are used in the prior art for sealing between the pipe connector 150 and the cylinder block 101 and between the pipe connector 150 and the rear head 103, for pressure tightness, as described hereinbefore, so that it is possible to decrease the number of component parts, which contributes to reduction of the manufacturing costs of the compressor.

Further, since the outer diameter of the rear head 3 can be decreased, it is possible to reduce the size and weight of the compressor.

Figure 7:
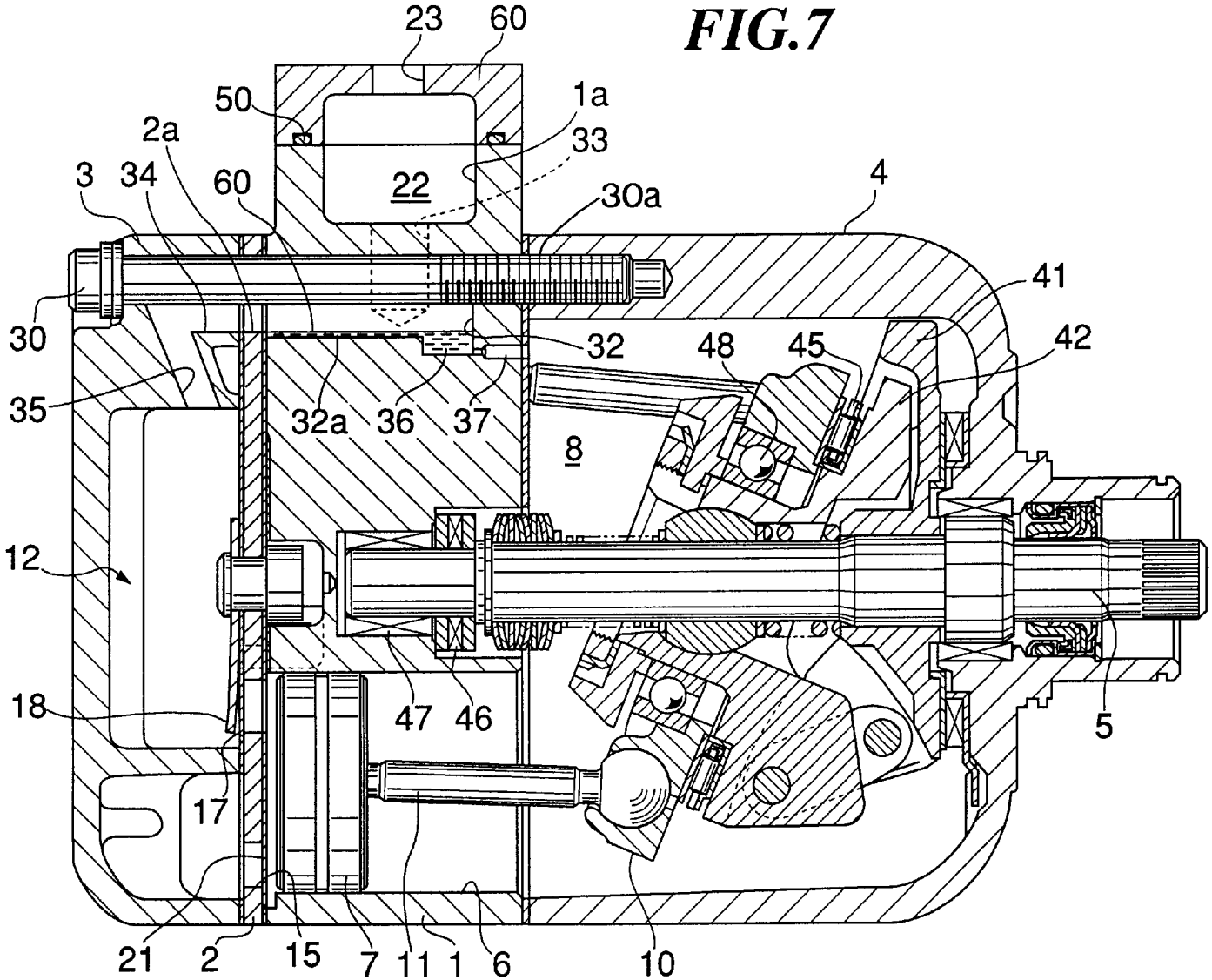
FIG. 7 is a longitudinal sectional view showing the whole arrangement of a wobble plate compressor according to a second embodiment of the invention.

FIG. 7 shows the whole arrangement of a wobble plate compressor according to a second embodiment of the invention. Component parts and elements corresponding to those of the above embodiments are indicated by identical reference numerals, and description thereof is omitted.

In the second embodiment, as shown in the figure, each space 32 has a bottom surface 32*a* thereof formed with an oil reservoir 36, and between the oil reservoir 36 and the crankcase 8, there is formed a restriction hole (guide passage) 37 through which oil is supplied from the oil reservoir 36 to the crankcase 8.

The bottom surface 32*a* of the space 32 is formed at a level lower than the through hole 2*a* formed through the valve plate 2 such that oil 60 can be collected in the space 32.

Refrigerant gas delivered to the discharge chamber 12 hits walls of the discharge chamber 12 and decelerates. The refrigerant gas within the discharge chamber 12 separates part of oil from itself, and then flows into the second high-pressure chamber 22. The refrigerant gas delivered to the second high-pressure chamber 22 expands, decelerates, and undergoes oil separation, followed by being discharged out of the compressor into the condenser, not shown.

The oil separated from the refrigerant gas within the second high-pressure chamber 22 is collected in the space 32 and the oil reservoir 36 via the communication passage 33, and then delivered to the crankcase 8 via the restriction hole 37.

The wobble plate compressor according to the second embodiment provides the same effects as obtained by the compressor according to the first embodiment.

Further, the wobble plate compressor of the second embodiment is distinguished from the conventional wobble plate compressor, in which oil is delivered from the discharge chamber 112 to the crankcase 8 via the restriction hole 126 formed in the vicinity of the rear head-side end of the drive shaft 105, in that oil separated from refrigerant gas within the second high-pressure chamber 22 is also delivered to the crankcase 8 via the restriction hole 37. In the conventional compressor, since oil is supplied from the discharge chamber 112 to the crankcase 8, it is impossible to supply a sufficient amount of oil to the crankcase 8 before the amount of oil collected within the discharge chamber 12 reaches a certain level. According to the wobble pate compressor of the second embodiment, oil separated from refrigerant gas within the second high-pressure chamber 22 can be supplied to the crankcase 8, which ensures sufficient cooling and lubrication of the thrust bearings 45, 46, the radial bearings 47, 48, and so forth, thereby preventing seizure of these bearings, even when the compressor is in a minimum delivery quantity condition under a high-speed low-load operating condition, in which the amount of flow of refrigerant gas is small.

Especially, when the compressor is in a high-speed low-load operating condition, the thrust bearing 45 has a large load applied thereto, so that the present embodiment is effective in preventing occurrence of seizure of the thrust bearing 45.

Although in the second embodiment, the whole bottom surface 32*a* of the space 32 is formed at a level lower than the hole 2*a* formed through the valve plate 2, this is not limitative, but the bottom surface 32*a* of the space 32 may be formed at the same level as the hole 2*a*. In this case, however, it is required that the bottom surface 32*a* be formed with an inclined surface sloping down to the oil reservoir 36.

Further, if the space 32 is formed such that it has a larger depth in the direction in which the through bolt 30 extends, refrigerant gas hits a threaded portion 30*a* of through bolt 30 to be decelerated, so that the space 32 is capable of performing separation of oil from refrigerant gas as well.

It is further understood by those skilled in the art that the foregoing is the preferred embodiments of the invention, and that various changes and modification may be made without departing from the spirit and scope thereof.

What is claimed is:

1. In a refrigerant compressor including a cylinder block having one end face, another end face, and an outer peripheral surface, a valve plate, a rear head secured to said one end face of said cylinder block via said valve plate, a front head secured to said another end face of said cylinder block, said front head having a crankcase formed therein, a first high-pressure chamber formed within said rear head, a second high-pressure chamber formed on said outer peripheral surface of said cylinder block, a discharge passage communicating between said first high-pressure chamber and said second high-pressure chamber, and a plurality of through bolts each extending from said rear head to said front head through said cylinder block, for tightening said rear head, said cylinder block, and said front head in a longitudinal direction, to form a one-piece assembly, the improvement wherein said discharge passage comprises at least one through hole through which corresponding ones of said through bolts extend, respectively, at least one communication passage communicating between said at least one through hole and said first high-pressure chamber, and at least one communication hole formed in said cylinder block for communication between said at least one through hole and said second high-pressure chamber.

2. A refrigerant compressor according to claim 1, wherein said cylinder block is formed therein with at least one space formed continuous with said at least through hole, respectively.

3. A refrigerant compressor according to claim 2, including an oil reservoir formed in a bottom surface of each of said at least one space for collecting oil therein, and an oil supply passage formed through a portion of said cylinder block between said oil reservoir and said crankcase for supplying said oil from said oil reservoir to said crankcase.

4. A refrigerant compressor according to claim 3, wherein said valve plate is formed therethrough with at least one through hole respectively continuous with said at least one space in said cylinder block, said bottom surface of said each of said at least one space being formed at a level lower than a corresponding one of said at least one through hole formed through said valve plate.

5. A refrigerant compressor according to claim 3, wherein said bottom surface of said each of said at least one space is formed at the same level as a corresponding one of said at least one through hole, said bottom surface having an inclined surface thereof sloping down to said oil reservoir.

6. A refrigerant compressor according to claim 3, wherein said each of said at least one space has a larger depth in a direction in which a corresponding one of said through bolts extend, in a manner such that refrigerant gas hits a threaded portion of said through bolt.

7. A refrigerant compressor according to claim 4, wherein said each of said at least one space has a larger depth in a direction in which a corresponding one of said through bolts extend, in a manner such that refrigerant gas hits a threaded portion of said through bolt.

8. A refrigerant compressor according to claim 5, wherein said each of said at least one space has a larger depth in a direction in which a corresponding one of said through bolts extend, in a manner such that refrigerant gas hits a threaded portion of said through bolt.

* * * * *